US010887685B1

(12) United States Patent
Harmke et al.

(10) Patent No.: US 10,887,685 B1
(45) Date of Patent: Jan. 5, 2021

(54) ADAPTIVE WHITE NOISE GAIN CONTROL AND EQUALIZATION FOR DIFFERENTIAL MICROPHONE ARRAY

(71) Applicant: MOTOROLA SOLUTIONS, INC., Chicago, IL (US)

(72) Inventors: Charles B. Harmke, Huntley, IL (US); Kurt S. Fienberg, Plantation, FL (US); Daniel Grobe Sachs, Elmhurst, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 13 days.

(21) Appl. No.: 16/511,737

(22) Filed: Jul. 15, 2019

(51) Int. Cl.

| | |
|---|---|
| ***H04R 1/32*** | (2006.01) |
| ***H04R 3/00*** | (2006.01) |
| ***H04R 3/04*** | (2006.01) |
| ***G10L 21/0216*** | (2013.01) |

(52) U.S. Cl.
CPC ..... *H04R 1/326* (2013.01); *G10L 21/0216* (2013.01); *H04R 3/005* (2013.01); *H04R 3/04* (2013.01); *G10K 2210/30231* (2013.01); *G10L 2021/02166* (2013.01); *H04R 2410/01* (2013.01); *H04R 2430/21* (2013.01); *H04R 2430/23* (2013.01)

(58) Field of Classification Search
CPC ..... H04R 1/326; H04R 2410/01; H04R 2430/21; H04R 2430/23; H04R 3/005; H04R 3/04; G10L 21/0216; G10L 2021/02166; G10K 2210/30231
USPC ..... 381/56, 57, 58, 71.1, 73.1, 91, 92, 122, 381/124
See application file for complete search history.

(56) References Cited

U.S. PATENT DOCUMENTS

| | | | | |
|---|---|---|---|---|
| 8,942,387 | B2 | 1/2015 | Elko et al. | |
| 9,202,475 | B2 | 12/2015 | Elko et al. | |
| 9,301,049 | B2 | 3/2016 | Elko et al. | |
| 9,521,486 | B1 * | 12/2016 | Barton | H04R 3/005 |
| 9,749,745 | B2 | 8/2017 | Chen et al. | |
| 9,961,437 | B2 | 5/2018 | McLaughlin et al. | |
| 10,117,019 | B2 | 10/2018 | Elko et al. | |
| 10,349,172 | B1 * | 7/2019 | Huang | H04R 19/04 |
| 2017/0110142 | A1 * | 4/2017 | Fan | G10L 21/0216 |
| 2017/0243577 | A1 * | 8/2017 | Wingate | G10L 15/20 |
| 2017/0374477 | A1 * | 12/2017 | Salvatucci | H04R 25/505 |

* cited by examiner

*Primary Examiner* — William A Jerez Lora
(74) *Attorney, Agent, or Firm* — Michael Best and Friedrich LLP

(57) ABSTRACT

Systems and methods for beamforming audio signals received from a microphone array. One example embodiment provides an electronic device. The electronic device includes a microphone array and an electronic processor communicatively coupled to the microphone array. The electronic processor is configured to estimate an ambient noise level. The electronic processor is configured to compare the ambient noise level to a first threshold and a second threshold, the second threshold being lower than the first threshold. The electronic processor is configured to determine a beam pattern for the microphone array based on the comparison of the ambient noise level to the first threshold and the second threshold. The electronic processor is configured to apply the beam pattern to an audio signal received by the microphone array.

20 Claims, 4 Drawing Sheets

ADAPTIVE WHITE NOISE GAIN CONTROL AND EQUALIZATION FOR DIFFERENTIAL MICROPHONE ARRAY

BACKGROUND OF THE INVENTION

Public safety and other two-way radio communications users often use remote speaker microphones. In noisy environments, a remote speaker microphone should be more sensitive to the voice of the user than it is to ambient noise. To accomplish this, some remote speaker microphones employ differential microphone arrays to form a directional response (that is, a beam pattern), which results in improved signal strength for audio received from a particular direction. Adaptive beamforming algorithms may be used to steer the beam pattern toward the desired sounds (for example, speech), while attenuating unwanted sounds (for example, ambient noise). Some remote speaker microphones employ multiple differential microphone arrays to produce a single voice output.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
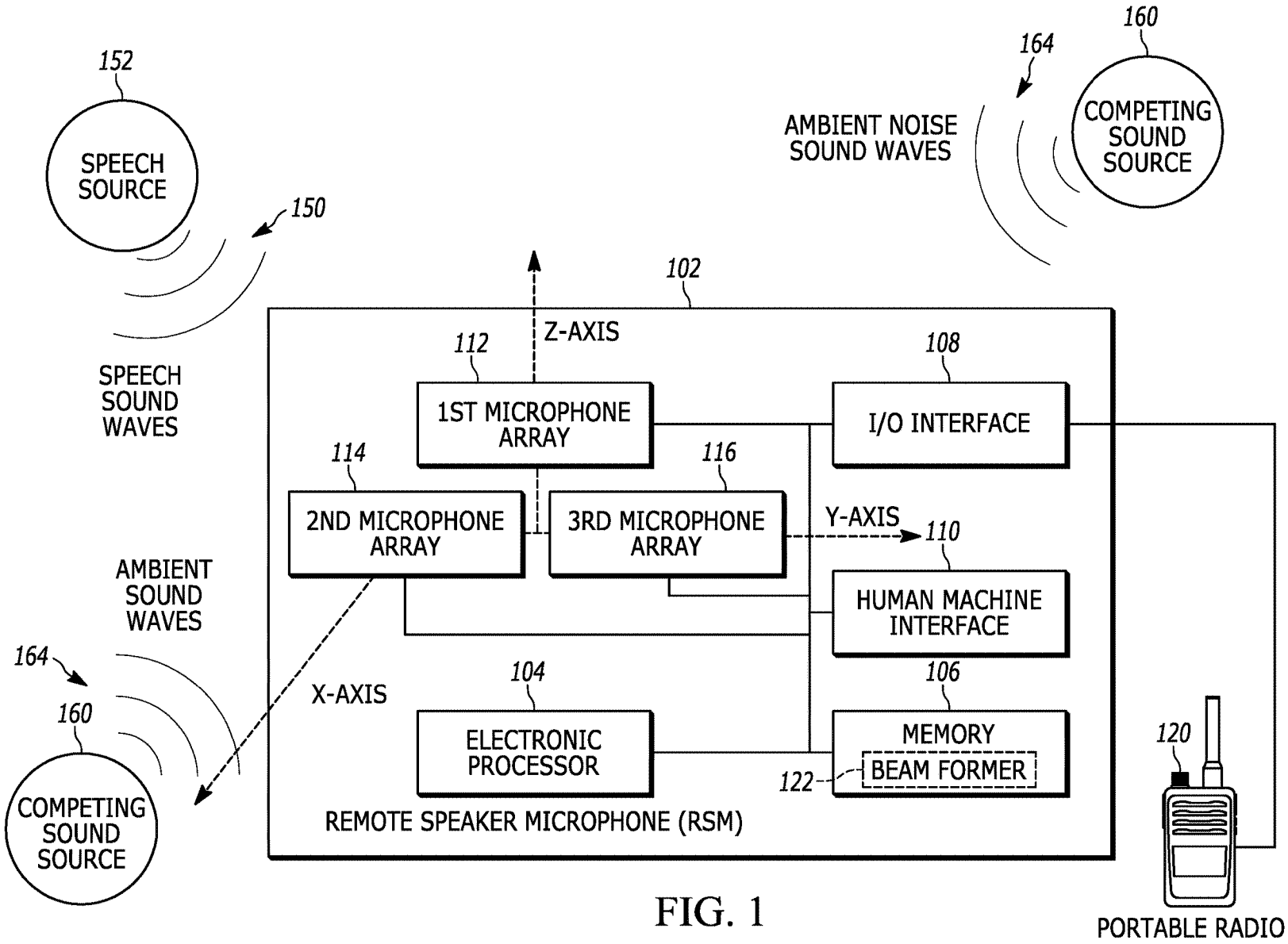
FIG. 1 is a block diagram of a remote speaker microphone, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some communications devices, (for example, remote speaker microphones) use microphone arrays (for example, differential microphone arrays) and adaptive beamforming to selectively receive sound coming from a particular direction, for example, from a user of the communications device. Differential microphone arrays (for example, broadside and endfire arrays) included in such devices are made up of two or more microphones (for example, micro-electrical-mechanical system (MEMS) microphones) spaced apart from one another along an axis. Such devices employ beam selection techniques to select beam patterns for the differential microphone arrays to focus audio reception on a desired sound source. Using such techniques, a communications device can enhance the ability to obtain desired speech from the user, and reduce interfering ambient noise to improve reception and the intelligibility of the received speech.

However, differential microphone arrays have a high-pass frequency dependence that increases (becomes more high-pass) as microphone spacing decreases and the target beam pattern becomes more directional. However, the high-pass frequency response of the raw differential microphone array requires equalization, which boosts any uncorrelated internal device noise and there-by causes a high noise floor. In some cases, this can lead to objectionable voice audio quality when external ambient noise is not sufficient to mask the internal device noise. Voice audio quality problems can be exacerbated when signals from multiple differential microphone arrays with different microphone spacing are mixed to form a single output.

To address this concern, some devices use microphone arrays with increased spacing. However, while this lowers the noise floor, it also reduces the usable bandwidth of the array. Additionally, as user demand and other factors lead to smaller product sizes, microphone array spacing is decreasing, not increasing. Some devices address this concern by using less directional beam patterns. This lowers the noise floor in quiet environments, but reduces the array's rejection of interfering ambient noise. Other approaches add microphones to the arrays, which leads to increased product cost. Finally, some approaches implement filters (for example, a Wiener filter) to filter the output to suppress noise. However, this is ineffective in applications where noise suppression is not a viable option (for example, automatic speech recognition). Filters are also ineffective when there are multiple microphone arrays on a device with different noise floors, because the noise floor can vary as the beam switches from one array to the other, which causes the Weiner filter to have difficulty with tracking the noise floor. Accordingly, systems and methods are provided herein for, among other things, adaptive white noise gain control and equalization for differential microphone arrays. Using embodiments described herein, differential microphone array beam patterns are adaptively ranged in directivity based on ambient noise.

One example embodiment provides an electronic device. The electronic device includes a microphone array and an electronic processor communicatively coupled to the microphone array. The electronic processor is configured to estimate an ambient noise level. The electronic processor is configured to compare the ambient noise level to a first threshold and a second threshold, the second threshold being lower than the first threshold. The electronic processor is configured to determine a beam pattern for the microphone array based on the comparison of the ambient noise level to the first threshold and the second threshold. The electronic processor is configured to apply the beam pattern to an audio signal received by the microphone array.

Another example embodiment provides a method for beamforming audio signals received from a microphone array. The method includes estimating an ambient noise level for an electronic device. The method includes comparing, with an electronic processor, the ambient noise level to a first threshold and a second threshold, the second threshold being lower than the first threshold. The method includes determining, with the electronic processor, a first beam pattern for a first microphone array positioned in the electronic device at a first orientation, the first beam pattern based on the comparison of the ambient noise level to the first threshold and the second threshold. The method includes comparing, with the electronic processor, the ambient noise level to a third threshold and a fourth threshold, the fourth threshold being lower than the third threshold. The method includes determining, with the electronic processor, a second beam pattern for a second microphone array positioned in the electronic device at a second orientation different from the first orientation, the second beam pattern based on the comparison of the ambient noise level to the third threshold and the fourth threshold. The method includes applying the first beam pattern to a first audio signal received by the first microphone array. The method includes applying the second beam pattern to a second audio signal received by the second microphone array.

For ease of description, some or all of the example systems presented herein are illustrated with a single exemplar of each of its component parts. Some examples may not describe or illustrate all components of the systems. Other example embodiments may include more or fewer of each of the illustrated components, may combine some components, or may include additional or alternative components.

It should be noted that, as used herein, the terms "beamforming" and "adaptive beamforming" refer to microphone beamforming using a differential microphone array, and one or more known or future-developed beamforming algorithms, or combinations thereof.

FIG. 1 is a block diagram of a remote speaker microphone (RSM) 102 (for example, a Motorola APX™ XE Remote Speaker Microphone). The remote speaker microphone 102 includes an electronic processor 104, a memory 106, an input/output (I/O) interface 108, a human machine interface 110, and three microphone arrays (a first microphone array 112, a second microphone array 114, and a third microphone array 116). The illustrated components, along with other various modules and components are coupled to each other by or through one or more control or data buses that enable communication therebetween. The use of control and data buses for the interconnection between and exchange of information among the various modules and components would be apparent to a person skilled in the art in view of the description provided herein.

In the example illustrated, the remote speaker microphone 102 is communicatively coupled (for example, using a wired or wireless connection) to a portable radio 120 to provide input to (for example, an audio signal) and receive output from the portable radio 120. The portable radio 120 may be a portable two-way radio, for example, one of the Motorola® APX™ family of radios. In some embodiments, the components of the remote speaker microphone 102 may be integrated into a body-worn camera, a portable radio, a converged device, or another similar electronic communications device.

The electronic processor 104 obtains and provides information (for example, from the memory 106 and/or the input/output interface 108), and processes the information by executing one or more software instructions or modules, capable of being stored, for example, in a random access memory ("RAM") area or a read only memory ("ROM") of the memory 106 or in another non-transitory computer readable medium (not shown). The software can include firmware, one or more applications, program data, filters, rules, one or more program modules, and other executable instructions. The electronic processor 104 is configured to retrieve from the memory 106 and execute, among other things, software related to the control processes and methods described herein.

The memory 106 can include one or more non-transitory computer-readable media, and includes a program storage area and a data storage area. The program storage area and the data storage area can include combinations of different types of memory, as described herein. In the embodiment illustrated, the memory 106 stores, among other things, an adaptive beam former 122 (described in detail below).

The input/output interface 108 is configured to receive input and to provide system output. The input/output interface 108 obtains information and signals from, and provides information and signals to, (for example, over one or more wired and/or wireless connections) devices both internal and external to the remote speaker microphone 102.

The human machine interface (HMI) 110 receives input from, and provides output to, users of the remote speaker microphone 102. The HMI 110 may include a keypad, switches, buttons, soft keys, indictor lights, haptic vibrators, a display (for example, a touchscreen), or the like. In some embodiments, the remote speaker microphone 102 is configurable by a user via the human machine interface 110.

The first microphone array 112 includes two or more microphones that sense sound, for example, the speech sound waves 150 generated by a speech source 152 (for example, a human speaking). In some embodiments, the first microphone array 112 is an endfire array. The first microphone array 112 converts the speech sound waves 150 to electrical signals, and transmits the electrical signals to the electronic processor 104. The second microphone array 114 and the third microphone array 116 contain similar components and operate similarly to the first microphone array 112. In the illustrated example, each of the first microphone array 112, the second microphone array 114, and the third microphone array 116 are positioned in a housing (not shown) of the remote speaker microphone 102 at a different orientation to pick up audio signals originating in different directions relative to the remote speaker microphone 102. For example, the microphone arrays may be oriented along the x, y, and z axes (relative to the housing) of the remote speaker microphone 102. The electronic processor 104 processes the electrical signals received from the first microphone array 112, the second microphone array 114, and the third microphone array 116, for example, using the adaptive beamformer 122 according to the methods described herein, to produce an output audio signal. The electronic processor 104 provides the output audio signal to the portable radio 120 for voice encoding and transmission.

In some embodiments, the first microphone array 112, the second microphone array 114, and the third microphone array 116 have different microphone spacing. In one example embodiment, the first microphone array 112 is spaced at fifteen millimeters, the second microphone array 114 is spaced at sixty-five millimeters, and the third microphone array 116 is spaced at fifteen millimeters. In some embodiments, the remote speaker microphone 102 has fewer than three microphone arrays.

Oftentimes, the speech source 152 is not the only source of sound waves near the remote speaker microphone 102. For example, a user of the remote speaker microphone 102 may be in an environment with a competing sound sources 160 (for example, equipment operating, traffic sounds, other people speaking, and the like), which produce ambient noise sound waves 164. In order to assure timely and accurate communications, the microphones of the first microphone array 112, the second microphone array 114, and the third microphone array 116 are configured to produce response defined by beam patterns to pick up desirable sound waves (for example, from the speech source 152), while attenuating undesirable sound waves (for example, from the competing sound sources 160).

Figure 2:
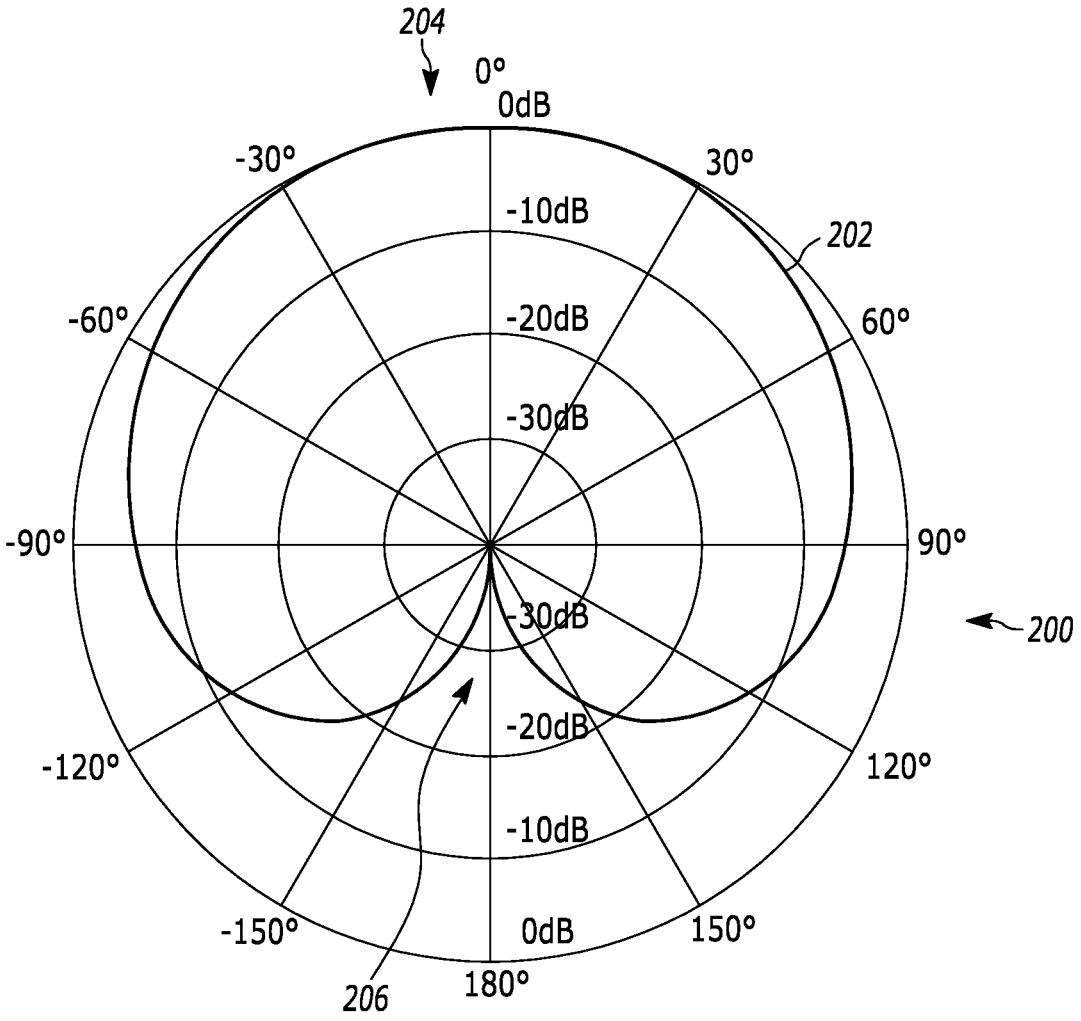
FIG. 2 is a polar chart of a beam pattern for a microphone array, in accordance with some embodiments.

In one example, as illustrated in FIG. 2, one of the microphone arrays may exhibit a cardioid beam pattern. FIG. 2 is a polar chart 200 that illustrates an example cardioid beam pattern 202. As shown in the polar chart 200, the beam pattern 202 exhibits zero dB of loss at the front 204, and exhibits progressively more loss along each of the sides until the beam pattern 202 produces a null 206. In the example, the null 206 exhibits thirty or more dB of loss. Accordingly, sound waves arriving at the front 204 of the beam pattern 202 are picked up, sound waves arriving at the sides of the beam pattern 202 are partially attenuated, and sound waves arriving at the null 206 of the beam pattern are fully attenuated. Adaptive beamforming algorithms use electronic signal processing (for example, executed by the electronic processor 104) to digitally "steer" the beam pattern 202 to focus on a desired sound (for example, speech) and to attenuate undesired sounds. An adaptive beamformer uses an adjustable set of weights (for example, filter coefficients) to combine multiple microphone sources into a single signal with improved spatial directivity. The adaptive beamforming algorithm uses numerical optimization to modify or update these weights as the environment varies. Such algorithms use many possible optimization schemes (for example, least mean squares, sample matrix inversion, and recursive least squares). Such optimization schemes depend on what criteria are used as an objective function (that is, what parameter to optimize). For example, when the main lobe of a beam is in a known fixed direction, beamforming could be based on maximizing signal-to-noise ratio or minimizing total noise not in the direction of the main lobe, thereby steering the nulls to the loudest interfering source. Accordingly, beamforming algorithms may be used with a microphone array (for example, the first microphone array 112) to isolate or extract speech sound under noisy conditions.

Figure 3:
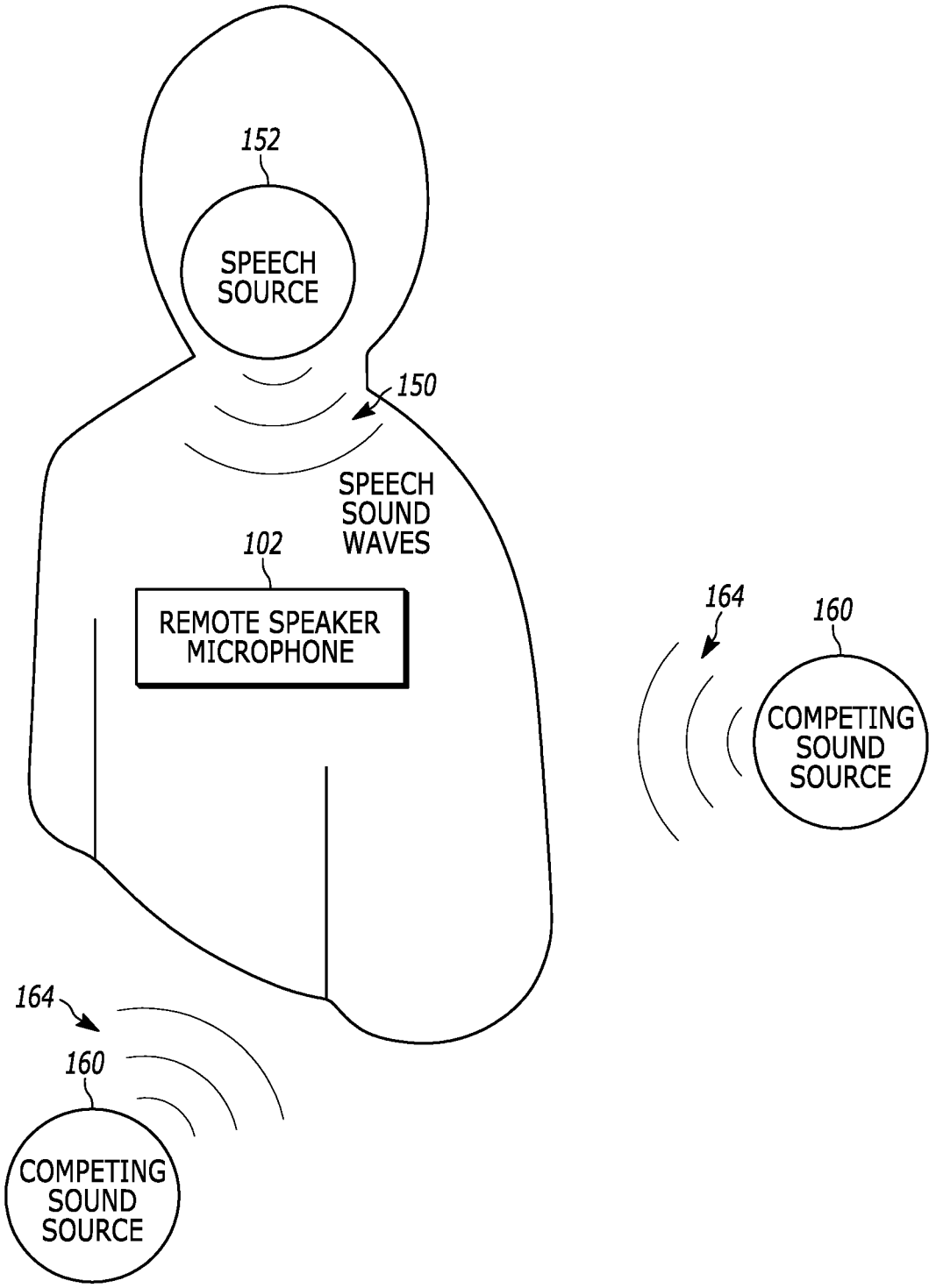
FIG. 3 illustrates a user (for example, a first responder) using a remote speaker microphone, in accordance with some embodiments.

For example, in FIG. 3, a user (that is, the speech source 152) is speaking and his or her voice (that is, the speech sound waves 150) arrives at the remote speaker microphone 102 along with some of the ambient noise sound waves 164. For example, user may be in the vicinity of other people who are talking, vehicles driving past, machinery operation, music playing, wind noise, and the like. As noted above, adaptive beamformers steer a beam to focus on a desired sound and to attenuate competing, undesired noises.

Current beamformers use directional beam patterns to pick up the user's voice (that is, the desired sound). However, such directional patterns may result in output signals that include too much internal device noise (self-noise) in situations where the competing sound sources 160 are not present. Accordingly, embodiments provide, among other things, methods for beamforming audio signals received from the microphone arrays based on the ambient noise levels.

By way of example, the methods presented are described in terms of the remote speaker microphone 102, as illustrated in FIG. 1. This should not be considered limiting. The systems and methods described herein could be applied to other forms of electronic communication devices (for example, portable radios, mobile telephones, speaker telephones, telephone or radio headsets, video or tele-conferencing devices, body-worn cameras, and the like), which utilize beamforming microphone arrays and may be used in environments containing competing sound sources.

Figure 4:
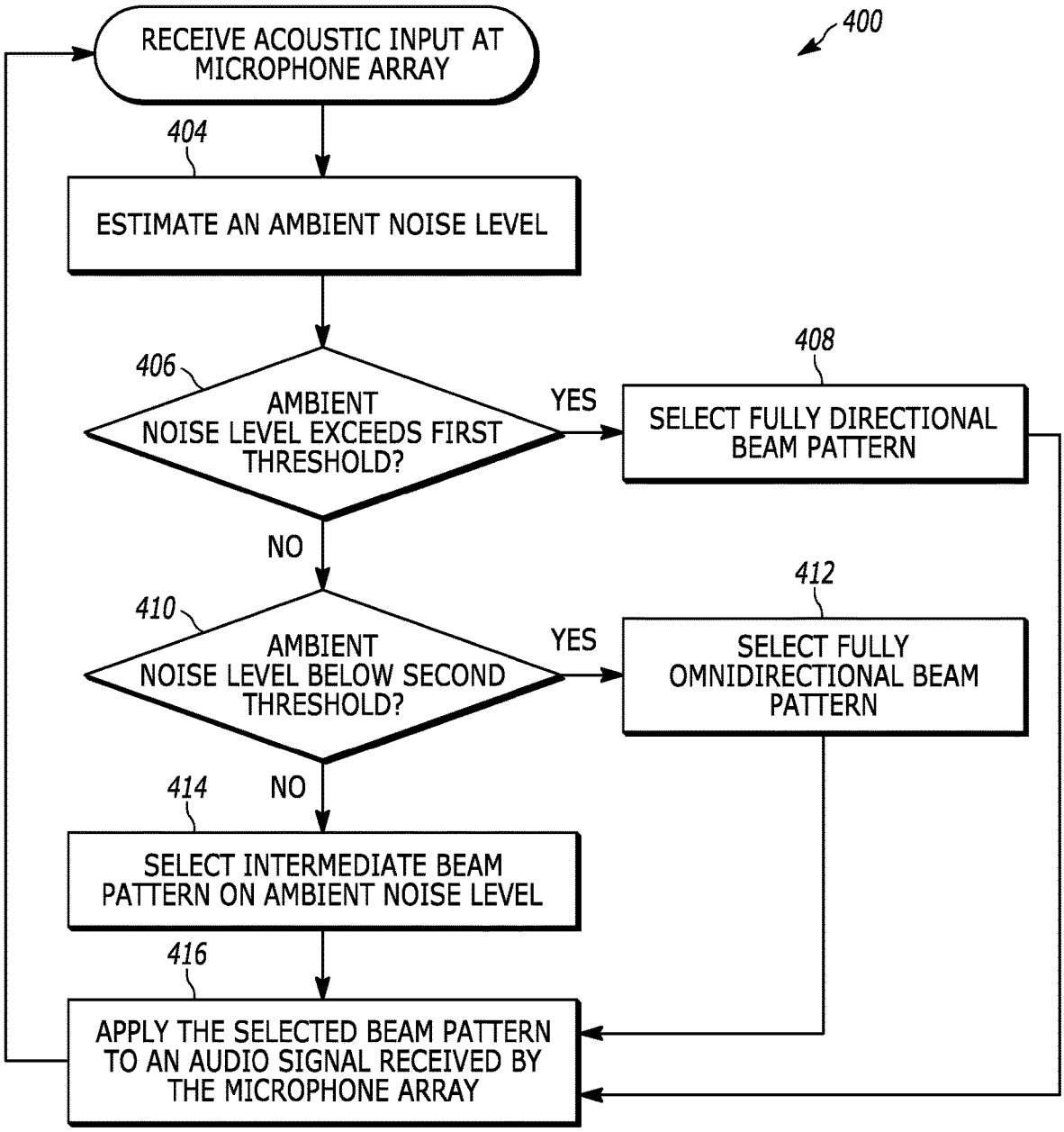
FIG. 4 is a flowchart of a method for beamforming audio signals received from one or more microphone arrays, in accordance with some embodiments.

FIG. 4 illustrates an example method 400 for beamforming audio signals received from a microphone array (for example, one of the first microphone array 112, the second microphone array 114, and the third microphone array 116). For descriptive purposes the method 400 is described largely in terms of a single "microphone array," which could be any one of the first microphone array 112, the second microphone array 114, and the third microphone array 116. However, it should be understood that the method 400 may be performed using two or more microphone arrays.

The method 400 is described as being performed by the remote speaker microphone 102 and, in particular, the electronic processor 104. However, it should be understood that in some embodiments, portions of the method 400 may be performed external to the remote speaker microphone 102 by other devices, including for example, the portable radio 120. For example, the remote speaker microphone 102 may be configured to send input audio signals from the first microphone array 112 to the portable radio 120, which, in turn, processes the input audio signals as described below.

The method 400 begins at block 402, with the electronic processor 104 receiving audio signals from the microphone array. The audio signals are electrical signals based on acoustic input from the speech sound waves 150 and the ambient noise sound waves 164, detected by the microphone array.

At block 404, the electronic processor 104 estimates the ambient noise level. In some embodiments, the electronic processor 104 estimates the ambient noise level using a moving average of an audio signal power for the microphone array. For example, a moving average of the audio signal power with a time constant significantly longer than the dynamic scale of speech results in measuring a relatively stable noise level and not rapidly varying speech. In some embodiments, the electronic processor 104 estimates the ambient noise level using a voice activity detection system. For example, the voice activity detection system could be used to identify when speech sounds were absent. An average ambient noise level measured during noise-only segments can be used to continuously estimate an ambient noise level.

The electronic processor 104, as described in detail below, compares the ambient noise level to a first threshold (e.g., an upper threshold) and a second threshold (e.g., a lower threshold) to determine a beam pattern. The first and second thresholds are audio power levels. In some embodiments, the first threshold's level is set such that the ambient noise masks an amplified self-noise associated with a fully directional configuration of the microphone array in a transmitted audio signal from the electronic device. In some embodiments, the second threshold's level, which is lower than the first threshold's level, is set such that the ambient noise fails to mask an amplified self-noise associated with a fully directional configuration of the microphone array in a transmitted audio signal from the electronic device.

At block 406, the electronic processor 104 determines whether the ambient noise level exceeds the first threshold level. At block 408, when the ambient noise level exceeds the first threshold, the electronic processor 104 determines a beam pattern by selecting a fully directional beam pattern. For example, the electronic processor may select a cardioid beam pattern (illustrated in FIG. 2), a supercardioid beam pattern, a hypercardioid beam pattern, a bi-directional beam pattern, or another suitable directional beam pattern. Adaptive beamforming algorithms can be applied on a single frequency band or on multiple sub-bands. In the case of sub-bands, each sub-band will have its own beam pattern. Because of the high-pass filter nature of differential microphone arrays, the lower frequencies will have more omnidirectional patterns when the ambient noise level is below the second threshold. The higher frequencies will be more directional.

When the ambient noise level does not exceed the first threshold, the electronic processor 104 determines whether the ambient noise level is below the second threshold, at block 410. At block 412, when the ambient noise level is below the second threshold, the electronic processor 104 determines a beam pattern by selecting an omnidirectional beam pattern.

When the ambient noise level is not below the second threshold, and does not exceed the first threshold, the ambient noise level is between the first threshold and the second threshold. At block 414, in response to this condition, the electronic processor 104 determines a beam pattern by selecting an intermediate beam pattern, between fully directional and omnidirectional, with a degree of directionality based on the ambient noise level. In some embodiments, selecting an intermediate beam pattern by varying a beamforming coefficient is based on the ambient noise level using a continuous monotonic function. For example, for a cardioid beam pattern, the beamformer output at frequency f can be described by the following equation:

$$Y(f)=X_1(f)-H(f)\cdot\exp(-jfT)\cdot X_2(f)$$

Where:

$X_1(f)$ is the raw omnidirectional signal from a first microphone of a two-microphone differential array;

$X_2(f)$ is the raw omnidirectional signal from a second microphone of a two-microphone differential array; and H(J) is the relative signal strength factor between the first and second microphones.

This example beamformer has a high pass filter frequency response (that is, it attenuates low frequencies). As a consequence, in this example, a beamformer equalization factor $H_{eq}(f)$ is applied at each frequency to flatten the response.

In order to adjust the beamformer response based on the ambient noise, a correction factor (K) is added:

$$Y(f)=X_1(f)-K\cdot H(f)\cdot\exp(-jfT)\cdot X_2(f)$$

The correction factor ranges from K=0 when the ambient noise level is at or below the lower threshold to K=1 when ambient noise level is high (for example, noise at or above the upper threshold). When K=0, the beamformer output is equal to the raw omnidirectional signal from the first microphone. When K=1, the beamformer output is equal to the classic cardioid pattern. In between the thresholds, K could be varied log-linearly with the ambient noise level to smoothly transition from an omnidirectional to cardioid beam pattern.

The beamformer equalization factor is also modified proportionally with K, from $H_{eq}(f)$ for the cardioid when K=1 to a flat Eq, such as by:

$$H_{eq},\mathrm{mod}(f)=1+K\cdot[H_{eq}(f)-1].$$

Regardless of which beam pattern is determined, at block 416, the electronic processor applies the beam pattern to an audio signal received by the microphone array to produce an audio output. As illustrated in FIG. 4, in some embodiments, the electronic processor continuously estimates the ambient noise level, and performs beam selection accordingly.

As noted above, in some embodiments, the remote speaker microphone 102 may include multiple microphone arrays (for example, the first microphone array 112 and the second microphone array 114). In such embodiments, the first microphone array 112 is positioned in the remote speaker microphone 102 at a first orientation (for example, along the z axis) and the second microphone array 114 is positioned at a second orientation different from the first orientation (for example, along the x axis). In such embodiments, the electronic processor 104, using methods described above, determines beam patterns separately for the first microphone array 112 and the second microphone array 114. In such embodiments, the second microphone array 114 has different characteristics from the first microphone array 112.

To determine the beam pattern for the second microphone array 114, a third threshold and a fourth threshold are used. The third threshold is analogous to the first threshold described above, and the fourth threshold is analogous to the second threshold. The values for the third and fourth thresholds are determined similarly to the values for the first and second thresholds, but using the characteristics of the second microphone array 114. The electronic processor 104 determines a second beam pattern for the second microphone array 114 based on the comparison of the ambient noise level to the third threshold and the fourth threshold, as described above with respect to the first microphone array 112. The electronic processor 104 applies the second beam pattern to a second audio signal received by the second microphone array. The beamformed audio signals from the first microphone array 112 and the second microphone array 114 are mixed to produce a combined audio output signal.

The method 400 may be applied similarly to embodiments of the remote speaker microphone 102, which include three microphone arrays.

Regardless of how it is generated, the audio output signal may then be further processed or transmitted to the portable radio 120 for voice encoding and transmission.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An electronic device comprising:

a microphone array; and an electronic processor communicatively coupled to the microphone array and configured to estimate an ambient noise level;

compare the ambient noise level to a first threshold and a second threshold, the second threshold being lower than the first threshold;

determine a beam pattern for the microphone array based on the comparison of the ambient noise level to the first threshold and the second threshold; and apply the beam pattern to an audio signal received by the microphone array.

2. The electronic device of claim 1, wherein the electronic processor is further configured to, when the ambient noise level exceeds the first threshold, determine a beam pattern by selecting a fully directional beam pattern.

3. The electronic device of claim 1, wherein the electronic processor is further configured to, when the ambient noise level is below the second threshold, determine a beam pattern by selecting an omnidirectional beam pattern.

4. The electronic device of claim 1, wherein the electronic processor is further configured to, when the ambient noise level is between the first threshold and the second threshold, determine a beam pattern by selecting an intermediate beam pattern based on the ambient noise level.

5. The electronic device of claim 4, wherein the electronic processor is further configured to select an intermediate beam pattern by varying a beamforming coefficient based on the ambient noise level using a continuous monotonic function.

6. The electronic device of claim 1, wherein the first threshold is set such that the ambient noise masks an amplified self-noise associated with a fully directional configuration of the microphone array in a transmitted audio signal from the electronic device.

7. The electronic device of claim 1, wherein the second threshold is set such that an ambient noise fails to mask an amplified self-noise associated with a fully directional configuration of the microphone array in a transmitted audio signal from the electronic device.

8. The electronic device of claim 1, wherein the microphone array is positioned in the electronic device at a first orientation, and the electronic device further comprises:

a second microphone array communicatively coupled to the electronic processor and positioned in the electronic device at a second orientation different from the first orientation;

wherein the electronic processor is configured to compare the ambient noise level to a third threshold and a fourth threshold, the fourth threshold being lower than the third threshold;

determine a second beam pattern for the second microphone array based on the comparison of the ambient noise level to the third threshold and the fourth threshold; and apply the second beam pattern to a second audio signal received by the second microphone array.

9. The electronic device of claim 1, wherein the electronic processor is further configured to estimate the ambient noise level using a moving average of an audio signal power for the microphone array.

10. The electronic device of claim 1, wherein the electronic processor is further configured to estimate the ambient noise level using a voice activity detection system.

11. The electronic device of claim 1, wherein the microphone array is a differential microphone array.

12. A method comprising:

estimating an ambient noise level for an electronic device;

comparing, with an electronic processor, the ambient noise level to a first threshold and a second threshold, the second threshold being lower than the first threshold;

determining, with the electronic processor, a first beam pattern for a first microphone array positioned in the electronic device at a first orientation, the first beam pattern based on the comparison of the ambient noise level to the first threshold and the second threshold;

comparing, with the electronic processor, the ambient noise level to a third threshold and a fourth threshold, the fourth threshold being lower than the third threshold;

determining, with the electronic processor, a second beam pattern for a second microphone array positioned in the electronic device at a second orientation different from the first orientation, the second beam pattern based on the comparison of the ambient noise level to the third threshold and the fourth threshold;

applying the first beam pattern to a first audio signal received by the first microphone array; and applying the second beam pattern to a second audio signal received by the second microphone array.

13. The method of claim 12, wherein when the ambient noise level exceeds the first threshold, determining a first beam pattern includes selecting a first fully directional beam pattern; and when the ambient noise level exceeds the third threshold, determining a second beam pattern includes selecting a second fully directional beam pattern.

14. The method of claim 12, wherein when the ambient noise level is below the second threshold, determining a first beam pattern includes selecting an omnidirectional beam pattern; and when the ambient noise level is below the fourth threshold, determining a second beam pattern includes selecting the omnidirectional beam pattern.

15. The method of claim 12, wherein when the ambient noise level is between the first threshold and the second threshold, determining a first beam pattern includes selecting a first intermediate beam pattern based on the ambient noise level; and when the ambient noise level is between the third threshold and the fourth threshold, determining a second beam pattern includes selecting a second intermediate beam pattern based on the ambient noise level.

16. The method of claim 15, wherein selecting the first and second intermediate beam patterns includes varying a beamforming coefficient based on the ambient noise level using a continuous monotonic function.

17. The method of claim 12, wherein the first threshold and the third threshold are set such that the ambient noise masks an amplified self-noise associated with a fully directional configuration of the microphone array in a transmitted audio signal from the electronic device.

18. The method of claim 12, wherein the second threshold and the fourth threshold are set such that an ambient noise fails to mask an amplified self-noise associated with a fully directional configuration of the microphone array in a transmitted audio signal from the electronic device.

19. The method of claim 12, wherein estimating the ambient noise level includes using a moving average of an audio signal power for at least one selected from the group consisting of first microphone array and the second microphone array.

20. The method of claim 12, wherein estimating the ambient noise level includes using a voice activity detection system.

* * * * *